US011920415B2

(12) United States Patent
Shearon et al.

(10) Patent No.: US 11,920,415 B2
(45) Date of Patent: Mar. 5, 2024

(54) INDEXING MECHANISMS

(71) Applicant: Schlumberger Technology Corporation, Sugar Land, TX (US)

(72) Inventors: Josiah Dale Shearon, Houston, TX (US); Juraj Irsa, Spring, TX (US); Patrick Virene, Cypress, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 53 days.

(21) Appl. No.: 17/594,932

(22) PCT Filed: Apr. 30, 2020

(86) PCT No.: PCT/US2020/030813
§ 371 (c)(1),
(2) Date: Nov. 3, 2021

(87) PCT Pub. No.: WO2020/227025
PCT Pub. Date: Nov. 12, 2020

(65) Prior Publication Data

US 2022/0213743 A1 Jul. 7, 2022

Related U.S. Application Data

(60) Provisional application No. 62/842,562, filed on May 3, 2019.

(51) Int. Cl.
*E21B 23/00* (2006.01)

(52) U.S. Cl.
CPC ..... *E21B 23/006* (2013.01)

(58) Field of Classification Search
CPC ..... E21B 23/006
See application file for complete search history.

(56) References Cited

U.S. PATENT DOCUMENTS

| | | | |
|---|---|---|---|
| 8,863,843 | B2 | 10/2014 | Wu et al. |
| 9,598,922 | B1 | 3/2017 | Beynon |
| 2004/0007356 | A1 | 1/2004 | Myron |
| 2010/0243253 | A1 | 6/2010 | Surjaatmadja |
| 2013/0025882 | A1 | 1/2013 | Streich |

(Continued)

FOREIGN PATENT DOCUMENTS

| | | | |
|---|---|---|---|
| RU | 2424417 | C1 | 7/2011 |
| RU | 2478776 | C1 | 4/2013 |
| RU | 174801 | U1 | 11/2017 |

OTHER PUBLICATIONS

International Preliminary Report on Patentability issued in International Patent application PCT/US2020/030813, dated Nov. 18, 2021, 9 pages.

(Continued)

*Primary Examiner* — Giovanna Wright
*Assistant Examiner* — Ronald R Runyan

(57) ABSTRACT

An indexing mechanism includes a piston. An indexing sleeve encases a portion of the piston. The indexing mechanism is longitudinally fixed to the piston, and is rotatable relative to the piston. The indexing sleeve includes an indexing track. An indexing ring surrounds less than an entirety of the indexing sleeve. The indexing ring is rotatable relative to the piston. The indexing ring includes an indexing pin that extends into the indexing track.

20 Claims, 13 Drawing Sheets

(56) References Cited

U.S. PATENT DOCUMENTS

| | | | | |
|---|---|---|---|---|
| 2014/0318806 | A1 | 5/2014 | Machocki | |
| 2016/0090815 | A1* | 3/2016 | Kennedy | E21B 23/006 166/374 |

OTHER PUBLICATIONS

International Search Report and Written Opinion issued in International Patent application PCT/US2020/030813 dated Aug. 11, 2020, 13 pages.

* cited by examiner

INDEXING MECHANISMS

CROSS-REFERENCE TO RELATED APPLICATIONS

This application is the U.S. national phase of International Patent Application No. PCT/US2020/030813, filed Apr. 30, 2020, and entitled "Indexing Mechanisms," which claims the benefit of, and priority to, U.S. Patent Application No. 62/842,562 filed on May 3, 2019, which is incorporated herein by this reference in its entirety.

BACKGROUND OF THE DISCLOSURE

A wellbore may include sections uphole from the wellbore bottom that may need to be expanded, or structures that may need to be removed after installed. These sections and structures may include plugs, casings, drill pipe, formation, and so forth. A downhole tool may include radially expandable cutting structures that may remove material from a wellbore wall. The radially expandable cutting structures may be actuated after the downhole tool has been tripped to a desired hole depth. The radially expandable cutting structures may be hydraulically actuated by changing the hydraulic pressure or a fluid flow rate from the surface.

SUMMARY

In some embodiments, an indexing mechanism includes a piston. An indexing sleeve encases a portion of the piston. The indexing mechanism is longitudinally fixed to the piston, and is rotatable relative to the piston. The indexing sleeve includes an indexing track. An indexing ring surrounds less than an entirety of the indexing sleeve. The indexing ring is rotatable relative to the piston. The indexing ring includes one or more indexing pins that extend into the indexing track.

In other embodiments, an indexing mechanism includes a piston. An indexing sleeve encases a portion of the piston. An indexing ring surrounds a portion of the indexing sleeve. The indexing ring includes a ring stop and one or more indexing pins. The indexing pin or pins extend into the indexing track. The indexing ring is rotatable relative to the piston.

In yet other embodiments, a method for operating an indexing mechanism includes moving a piston from a first longitudinal piston position to a second longitudinal piston position. The method includes rotating at least one of an indexing sleeve or an indexing ring relative to the piston into a first indexing alignment. The indexing ring encases less than an entirety of the piston. The indexing ring surrounds a portion of the indexing sleeve. The first indexing alignment aligns a ring stop on the indexing ring with a first sleeve stop on the indexing sleeve such that the first sleeve stop contacts the ring stop in the second longitudinal piston position.

This summary is provided to introduce a selection of concepts that are further described below in the detailed description. This summary is not intended to identify key or essential features of the claimed subject matter, nor is it intended to be used as an aid in limiting the scope of the claimed subject matter.

Additional features and advantages of embodiments of the disclosure will be set forth in the description which follows, and in part will be obvious from the description, or may be learned by the practice of such embodiments. The features and advantages of such embodiments may be realized and obtained by means of the instruments and combinations particularly pointed out in the appended claims. These and other features will become more fully apparent from the following description and appended claims, or may be learned by the practice of such embodiments as set forth hereinafter.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which:

FIG. 2-1 is a perspective view of an indexing mechanism, according to at least one embodiment of the present disclosure;

FIG. 2-2 is a cross-sectional view of a downhole tool including the indexing mechanism of FIG. 2-1, according to at least one embodiment of the present disclosure;

FIG. 4-1 is a view of an indexing track, according to at least one embodiment of the present disclosure;

FIG. 4-2 is another view of an indexing track, according to at least one embodiment of the present disclosure;

FIG. 5-1 is a perspective view of an indexing mechanism, according to at least one embodiment of the present disclosure;

FIG. 5-2 is a cross-sectional view of a downhole tool including the indexing mechanism of FIG. 2-2, according to at least one embodiment of the present disclosure;

FIG. 7-1 is a perspective view of another indexing mechanism, according to at least one embodiment of the present disclosure;

FIG. 7-2 is a cross sectional view of a downhole tool including the indexing mechanism of FIG. 7-1, according to at least one embodiment of the present disclosure;

DETAILED DESCRIPTION

Figure 1:
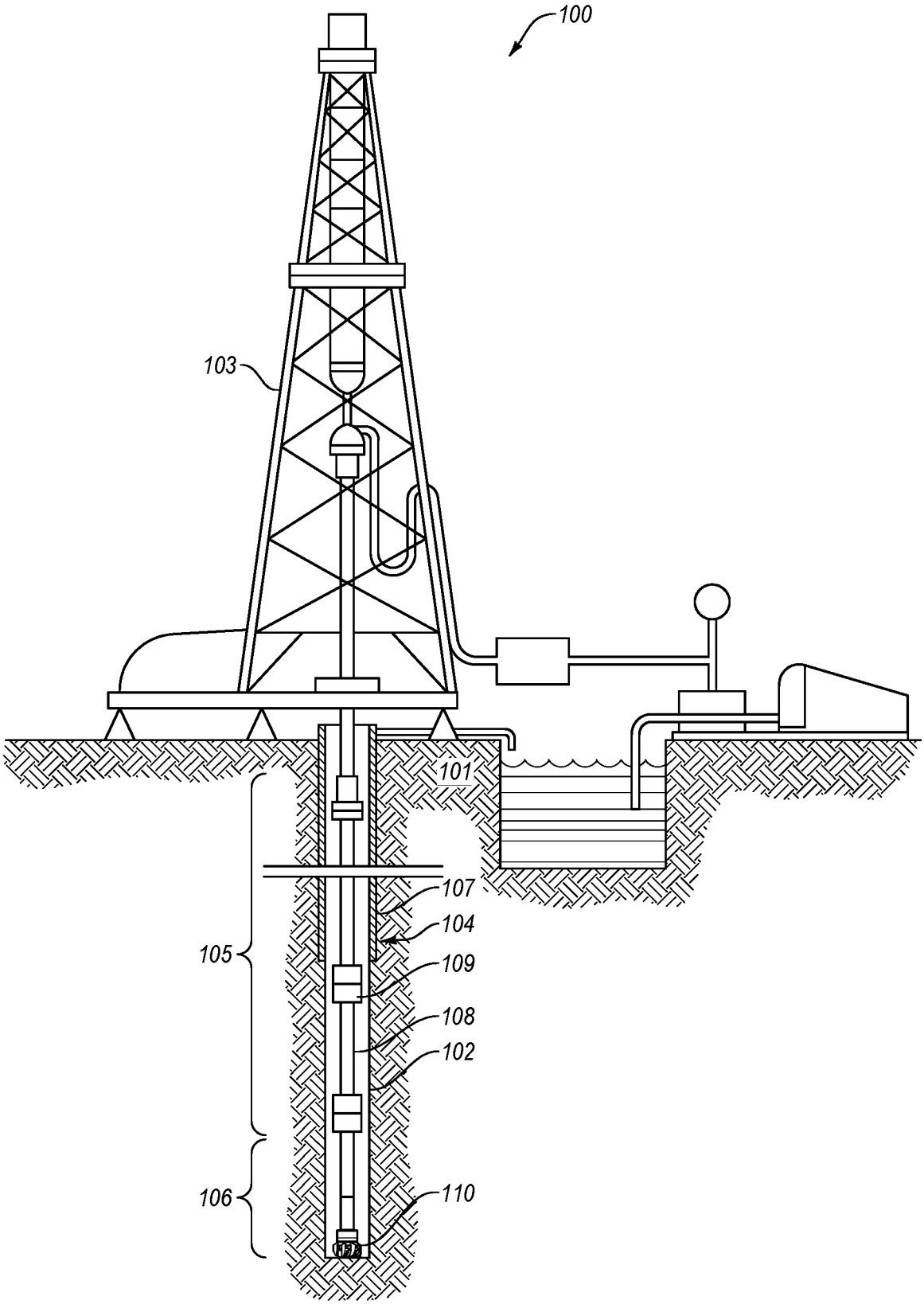
FIG. 1 is a partial cut-away view of a drilling system, according to at least one embodiment of the present disclosure.

This disclosure generally relates to devices, systems, and methods for actuating a downhole tool using an indexing mechanism. FIG. 1 shows one example of a drilling system 100 for drilling an earth formation 101 to form a wellbore 102. The drilling system 100 includes a drill rig 103 used to turn a drilling tool assembly 104 which extends downward into the wellbore 102. The drilling tool assembly 104 may include a drill string 105, a bottom hole assembly ("BHA") 106, and a bit 110, attached to the downhole end of drill string 105.

The drill string 105 may include several joints of drill pipe 108 connected end-to-end through tool joints 109. The drill string 105 transmits drilling fluid through a central bore and transmits rotational power from the drill rig 103 to the BHA 106. In some embodiments, the drill string 105 may further include additional components such as subs, pup joints, etc. The drill pipe 108 provides a hydraulic passage through which drilling fluid is pumped from the surface. The drilling fluid discharges through selected-size nozzles, jets, or other orifices in the bit 110 for the purposes of cooling the bit 110 and cutting structures thereon, and for lifting cuttings out of the wellbore 102 as it is being drilled.

The BHA 106 may include the bit 110 or other components. An example BHA 106 may include additional or other components (e.g., coupled between to the drill string 105 and the bit 110). Examples of additional BHA components include drill collars, stabilizers, measurement-while-drilling ("MWD") tools, logging-while-drilling ("LWD") tools, downhole motors, underreamers, section mills, hydraulic disconnects, jars, vibration or dampening tools, other components, or combinations of the foregoing.

In general, the drilling system 100 may include other drilling components and accessories, such as special valves (e.g., kelly cocks, blowout preventers, and safety valves). Additional components included in the drilling system 100 may be considered a part of the drilling tool assembly 104, the drill string 105, or a part of the BHA 106 depending on their locations in the drilling system 100.

The bit 110 in the BHA 106 may be any type of bit suitable for degrading downhole materials. For instance, the bit 110 may be a drill bit suitable for drilling the earth formation 101. Example types of drill bits used for drilling earth formations are fixed-cutter or drag bits. In other embodiments, the bit 110 may be a mill used for removing metal, composite, elastomer, other materials downhole, or combinations thereof. For instance, the bit 110 may be used with a whipstock to mill into casing 107 lining the wellbore 102. The bit 110 may also be a junk mill used to mill away tools, plugs, cement, other materials within the wellbore 102, or combinations thereof. Swarf or other cuttings formed by use of a mill may be lifted to surface, or may be allowed to fall downhole.

Figures 1, 2:
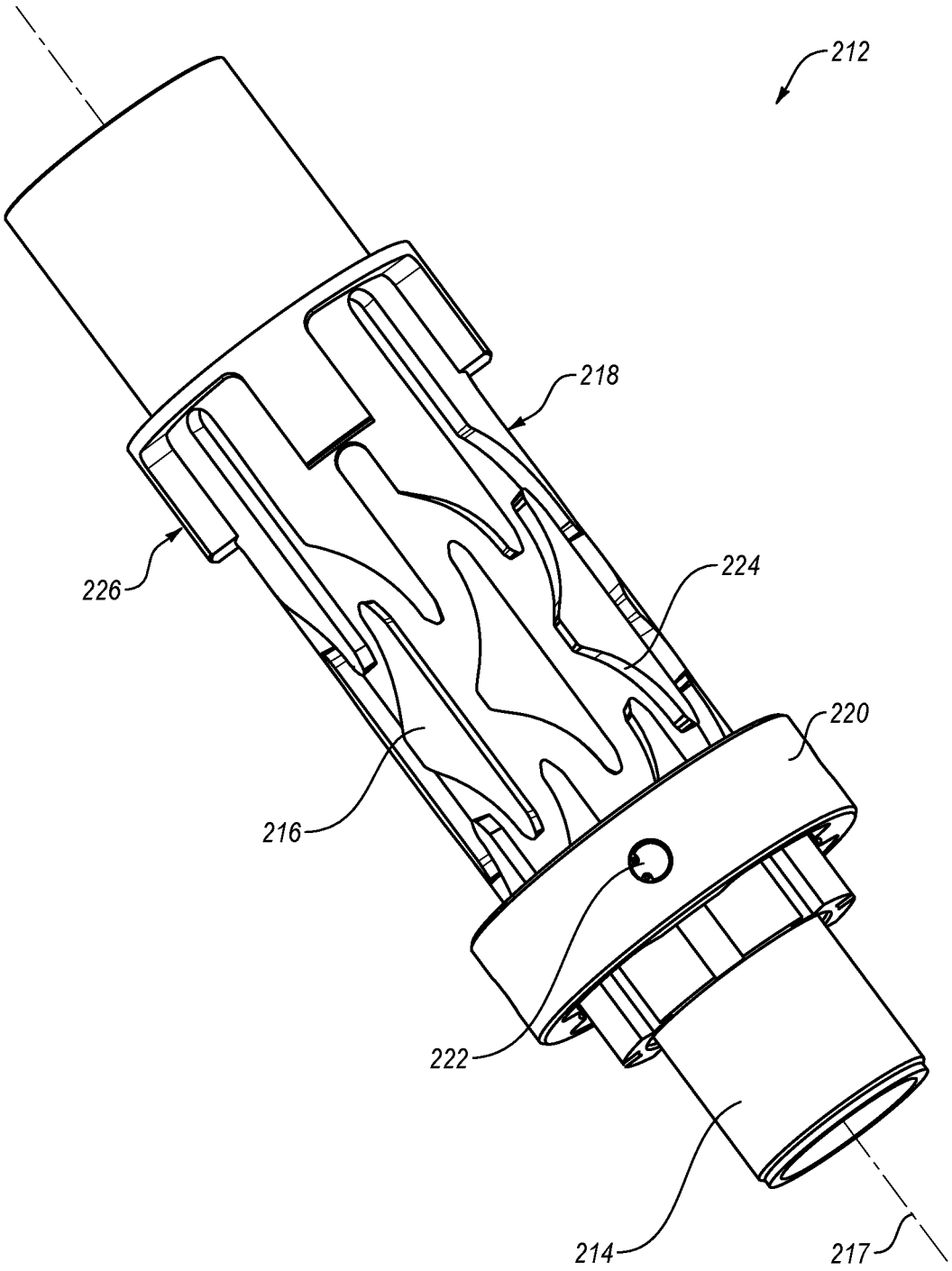
Figure 2:
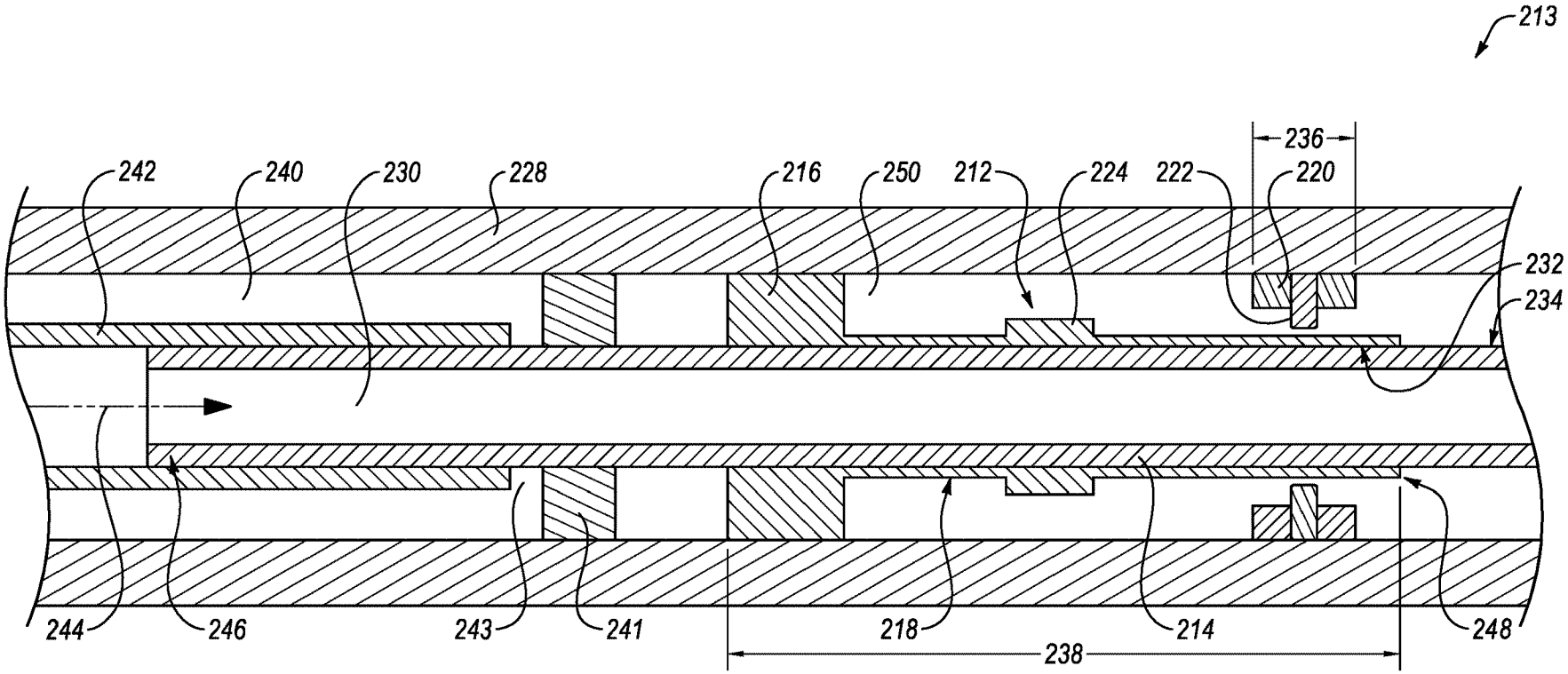

FIG. 2-1 is a perspective view of a representation of a indexing mechanism 212, according to at least one embodiment of the present disclosure. The indexing mechanism 212 may include a piston 214. An indexing sleeve 216 may encase a portion of the piston 214. In other words, the indexing sleeve 216 may surround at least a portion of the piston 214. In some embodiments, the indexing sleeve 216 may encase less than an entirety of the piston 214. In at least one embodiment, the indexing sleeve 216 may be coaxial with the piston 214 about a longitudinal axis 217. The indexing sleeve 216 may include an indexing track 218. The indexing track 218 may include a series of walls and/or tracks on the indexing sleeve 216.

The indexing mechanism 212 may include an indexing ring 220. The indexing ring 220 may surround at least a portion of the indexing sleeve 216, and therefore, the indexing ring 220 may surround at least a portion of the piston 214. In at least one embodiment, the indexing ring 220 may surround less than an entirety of the indexing sleeve 216. The indexing ring 220 may be coaxial with the piston 214 and the indexing sleeve 216 about the longitudinal axis 217. The indexing ring 220 may include an indexing pin 222. The indexing pin 222 may be inserted into the indexing track 218.

The indexing sleeve 216 may be rotatable relative to the piston 214 about the longitudinal axis 217. Furthermore, the indexing sleeve 216 may be rotatable relative to the piston 214 and the indexing ring 220 about the longitudinal axis 217. The indexing ring 220 may be rotatable relative to the piston 214 about the longitudinal axis 217. Furthermore, in at least one embodiment, the indexing ring 220 may be rotatable relative to the piston 214 and the indexing sleeve 216 about the longitudinal axis 217.

In some embodiments, the indexing sleeve 216 may be longitudinally fixed to the piston 214. In other words, when the piston 214 moves along the longitudinal axis 217, the indexing sleeve 216 may move along the longitudinal axis 217 with the piston 214. In at least one embodiment, the piston 214 and the indexing sleeve 216 may be longitudinally movable along the longitudinal axis 217 relative to the indexing ring 220. As the indexing sleeve 216 moves longitudinally relative to the indexing ring 220, the indexing pin 222 may contact a wall 224 of the indexing track 218. Contacting the wall 224 of the indexing track 218 may cause the wall 224 to push on the indexing pin 222 and the indexing pin 222 to push on the wall 224. This pushing may result in a torque about the longitudinal axis 217 that acts on both the indexing sleeve 216 and the indexing ring 220. When the torque exceeds a breakout torque of at least one of the indexing sleeve 216 and/or the indexing ring 220, one or both of the indexing sleeve 216 and/or the indexing ring 220 may rotate relative to the piston 214 about the longitudinal axis 217. Thus, the indexing sleeve 216 and the indexing ring 220 may rotate relative to the piston 214 in response to the longitudinal motion of the piston 214. In other words, the indexing sleeve 216 and the indexing ring 220 may rotate relative to the piston 214 in response to the indexing pin 222 engaging the wall 224 of the indexing track 218.

For example, when the torque exceeds the sleeve breakout torque of the indexing sleeve 216 but not the ring breakout torque of the indexing ring 220, the indexing sleeve 216 may rotate relative to the piston 214 and the indexing ring 220. In this manner, the sleeve breakout torque may be less than the ring breakout torque. In other examples, when the torque exceeds the ring breakout torque but not the sleeve breakout torque, the indexing ring 220 may rotate relative to the piston 214 and the indexing sleeve 216. In still other examples, the torque may exceed both the ring breakout torque and the sleeve breakout torque, and both the indexing sleeve 216 and the indexing ring 220 may rotate relative to each other and the piston 214.

The torque exerted on the indexing sleeve 216 may be opposite the torque exerted on the indexing ring 220. Thus, the torque may cause the indexing sleeve 216 to rotate in a first direction, and the indexing ring 220 to rotate in a second direction, the first direction being different than the second direction. For example, in the embodiment shown in FIG. 2-1, if the indexing sleeve 216 were moved along the longitudinal axis 217 in a downhole direction (i.e., such that an uphole end 226 of the indexing sleeve 216 moves toward the indexing ring 220), the indexing pin 222 may engage a portion of the wall 224 that is curved clockwise. This engagement may cause the indexing sleeve 216 to rotate counter-clockwise as viewed from the uphole end 226, and the indexing ring 220 to rotate clockwise as viewed from the uphole end 226. In other examples, the wall 224 may be oriented in a different direction, thereby causing the indexing sleeve 216 to rotate clockwise and the indexing ring 220 to rotate counter-clockwise.

Including an indexing sleeve 216 and an indexing ring 220 that both rotate may increase the reliability of the indexing mechanism 212. For example, if the indexing sleeve 216 jams, then the indexing ring 220 may still be able to rotate, and the indexing mechanism 212 may be able to cycle. Similarly, if the indexing ring 220 jams, then the indexing sleeve 216 may still be able to rotate, and the indexing mechanism 212 may be able to cycle. Thus, the indexing mechanism 212 may cycle more reliably, or may have a longer operational life between servicing. This may decrease the amount of times that the drill string needs to be tripped out of the hole, thereby potentially decreasing costs.

Furthermore, including the indexing track 218 on the indexing sleeve 216 may reduce the overall manufacturing complexity of a downhole tool. For example, machining the indexing track 218 may be one of the last manufacturing steps taken in the fabrication of a downhole tool. If a mistake is made during machining of an indexing track 218 located directly on a piston 214, then the entire piston 214 must be discarded, which may represent a loss of a significant investment in materials, consumables, labor, and so forth. By including the indexing track 218 on the indexing sleeve 216, if a mistake is made during machining of the indexing track 218, then only the indexing sleeve 216 must be discarded, which may represent significantly less of an investment in materials, consumables, labor, and so forth than the piston. Thus, the indexing sleeve 216 reduces the complexity of the manufacturing process, and also reduces the risk of having to re-manufacture an entire piston 214.

Furthermore, including an indexing sleeve 216 that is separate from the piston 214 may reduce the mass that is rotated when the indexing mechanism 212 is cycled. A lower mass may reduce the amount of torque required to rotate the indexing sleeve 216. This may reduce the forces experienced by the indexing pin 222 and/or the wall 224. Reducing the torque and the forces on the indexing pin 222 and/or the wall 224 may reduce the chance of the indexing pin 222 failing by fracturing, shearing, and so forth. In at least one embodiment, an indexing ring 220 may have a lower mass than the indexing sleeve 216. This means that the indexing ring 220 may require a lower torque to rotate than the indexing sleeve, thereby further reducing forces on the indexing pin 222 and/or the wall 224.

The indexing sleeve 216 has a sleeve mass. In some embodiments, the sleeve mass may be in a range having an upper value, a lower value, or upper and lower values including any of 1 kg, 2 kg, 3 kg, 4 kg, 5 kg, 6 kg, 7 kg, 8 kg, 9 kg, 10 kg, 15 kg, 20 kg, or any value therebetween. For example, the sleeve mass may be greater than 1 kg. In another example, the sleeve mass may be less than 20 kg. In yet other examples, the sleeve mass may be any value in a range between 1 kg and 20 kg. In some embodiments it may be critical that the sleeve mass is 8 kg or less to reduce the chance of failure of the indexing pin 222.

The indexing ring 218 has a ring mass. In some embodiments, the ring mass may be in a range having an upper value, a lower value, or upper and lower values including any of 0.25 kg, 0.5 kg, 0.75 kg, 1 kg, 2 kg, 3 kg, 4 kg, 5 kg, 6 kg, 7 kg, 8 kg, 9 kg, 10 kg, or any value therebetween. For example, the ring mass may be greater than 0.25 kg. In another example, the ring mass may be less than 10 kg. In yet other examples, the ring mass may be any value in a range between 0.25 kg and 10 kg. In some embodiments it may be critical that the ring mass is 2 kg or less to reduce the chance of failure of the indexing pin 222.

The indexing sleeve 216 and the indexing ring 220 have a mass ratio that is the ratio of the ring mass to the sleeve mass. In some embodiments, the mass ratio may be in a range having an upper value, a lower value, or upper and lower values including any of 1:1, 1:1.5, 1:2, 1:2.5, 1:3, 1:3.5, 1:4, 1:4.5, 1:5, 1:6, 1:7, 1:8, 1:9, 1:10, or any value therebetween. For example, the mass ratio may be greater than 1:1. In another example, the mass ratio may be less than 1:10. In yet other examples, the mass ratio may be any value in a range between 1:1 and 1:10. In some embodiments it may be critical that the mass ratio less than 1:4 to improve the reliability of the indexing mechanism 212.

FIG. 2-2 is a cross-sectional view of a downhole tool 213, including a cross-sectional view of the indexing mechanism 212 of FIG. 2-1. The downhole tool 213 includes a housing 228. A piston 214 may be located inside a central bore 230 of the housing 228. An indexing sleeve 216 may encompass less than an entirety of the piston 214. In other words, an inner surface 232 of the indexing sleeve 216 may abut an outer surface 234 of the piston 214.

An indexing ring 220 may surround at least a portion of the indexing sleeve 216. For example, the indexing ring 220 has an indexing ring width 236 and the indexing sleeve 216 has an indexing sleeve width 238. The indexing ring width 236 and the indexing sleeve width 238 affect the mass of the indexing ring 220 and the indexing sleeve 216, respectively. For example, a larger indexing ring width 236 results in a heavier indexing ring 220, and a smaller indexing ring width 236 results in a lighter indexing ring 220.

As described herein, the indexing ring may surround less than an entirety of the indexing sleeve. For example, the indexing ring width 236 is a ring percentage of the indexing sleeve width 238. In some embodiments, the ring percentage may be in a range having an upper value, a lower value, or upper and lower values including any of 5%, 10%, 12%, 14%, 15%, 16%, 18%, 20%, 25%, 30%, 35%, 40%, 45%, 50%, or any value therebetween. For example, the ring percentage may be greater than 5%. In another example, the ring percentage may be less than 50%. In yet other examples, the ring percentage may be any value in a range between 5% and 50%. In some embodiments it may be critical that the ring percentage is less than 10% to improve the reliability of the indexing mechanism 212.

The housing 228 may include a fluid path 240. The fluid path 240 may be sealed by a sealing member 241 between the fluid path 240 and the piston 214. The piston 214 may pass through a channel wall 242 such that the channel wall 242 separates the central bore 230 from the fluid path 240. The channel wall 242 may include a channel opening 243. In the position shown in FIG. 2-2, the channel opening 243 is sealed from the central bore 230 by the piston 214.

A fluid flow 244 may pass through the central bore 230 with a volumetric flow rate that is related to a fluid pressure. The fluid pressure may push on an uphole end 246 of the piston 214. As the volumetric flow rate increases, the fluid pressure may urge the uphole end 246 of the piston 214 downhole. A biasing member (not shown) located past a downhole end 248 of the indexing mechanism 212 may urge the piston 214 uphole. The biasing member may be any biasing member, such as a coil spring, a Bellville washer, a leaf spring, a wave spring, a hydraulic or pneumatic piston, or other biasing member. When the fluid pressure exerts a force on the piston 214 that is greater than the opposing force from the biasing member, the piston 214 may move downhole. In at least one embodiment, the piston 214 may move downhole enough that the fluid flow 244 may pass into the fluid path 240. The fluid path 240 may be directed to hydraulically actuate a downhole tool, including an expandable tool such as a reamer, a section mill, other expandable tool, an expandable stabilizer, an anchor, a bypass valve, a packing element, another downhole tool, or combinations of the foregoing.

In the embodiment shown in FIG. 2-2, the indexing mechanism 212 is in a low-flow state. In other words, the fluid pressure from the fluid flow 244 is insufficient to overcome the opposing force from the biasing member. In this state, the fluid path 240 is blocked, and the downhole tool is not actuated. As the fluid flow 244 increases, the piston 214 moves downhole, the indexing sleeve 216 may move downhole with the piston 214. An indexing pin 222 may be inserted into a track 250 of an indexing track 218. When the indexing pin 222 engages a wall 224 of the indexing track 218, one or both of the indexing sleeve 216 and the indexing ring 220 may rotate to allow the piston 214 and the indexing sleeve 216 to continue to move longitudinally downhole as the fluid flow is increased.

Figure 3:
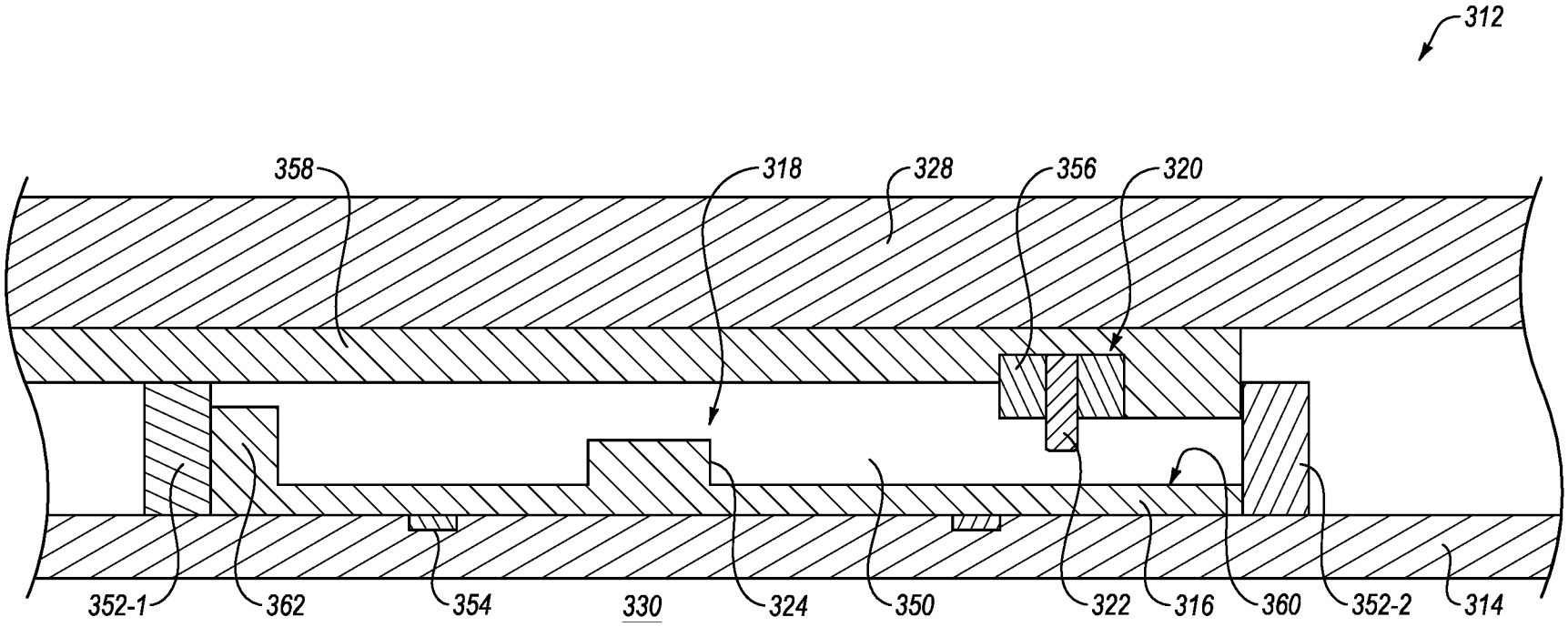
FIG. 3 is a cross-sectional view of an indexing mechanism, according to at least one embodiment of the present disclosure.

FIG. 3 is a close-up cross-sectional view of an indexing mechanism 312, according to at least one embodiment of the present disclosure. The indexing mechanism 312 may include a housing 328. A piston 314 may be located in a central bore 330 of the housing 328. An indexing sleeve 316 may encompass at least less than an entirety of the piston 314. In other words, the indexing sleeve 316 may surround a portion of the piston 314. The indexing sleeve may be longitudinally fixed to the piston 314 by an upper sleeve block 352-1 and a lower sleeve block 352-2. The upper sleeve block 352-1 and the lower sleeve block 352-2 may prevent the indexing sleeve 316 from moving longitudinally relative to the piston 314. For example, when the piston 314 moves downhole (i.e., toward the lower sleeve block 352-2), the indexing sleeve 316 may push against the upper sleeve block 352-1. Similarly, when the piston 314 moves uphole (i.e., toward the upper sleeve block 352-1), the indexing sleeve 316 may push against the lower sleeve block 352-2.

The indexing sleeve 316 may be rotatable relative to the piston 314. In at least one embodiment, the indexing sleeve 316 may rotate directly against the piston 314, without any bearings. In other embodiments, the indexing sleeve 316 may rotate against a radial bearing 354 between the indexing sleeve 316 and the piston 314. In at least one embodiment, including a radial bearing 354 may decrease the torque required to rotate the indexing sleeve 316. Furthermore, in the same or other embodiments, the radial bearings 354 may help to centralize the indexing sleeve 316 with respect to the piston 314. Rotating against the piston 314 without any bearings may reduce the cost and complexity of the indexing mechanism 312.

The indexing mechanism 312 may include an indexing ring 320. The indexing ring 320 may include an indexing pin 322 fixed to the indexing ring 320. The indexing pin 322 may be located in a ring stop 356 located in the indexing ring 320. For example, the indexing pin 322 may be inserted into a bore in the ring stop 356. In some embodiments, the indexing pin 322 may be connected to the ring stop 356 with a mechanical connection, such as a threaded connection, a press-fit, an interference fit, a snap ring, a locking pin, a cotter pin, a shear pin, or other mechanical connection. In other embodiments, the indexing pin 322 may be connected to the ring stop 356 with a weld, braze, or other joining process. In some embodiments, the indexing pin 322 and the ring stop 356 may be formed of a single unitary piece. For example, a blank may be machined to form the ring stop 356 and the indexing pin. Including the indexing pin 322 in the ring stop 356 may strengthen the indexing pin 322 for the contact between the indexing pin 322 and a wall 324 of the indexing track 318. Furthermore, including the indexing pin 322 with the ring stop 356 may shorten the indexing mechanism 312 and allow a sleeve stop 362 on the indexing sleeve 316 to be located uphole of the indexing ring 320 and the ring stop 356.

In some embodiments, the indexing pin 322 may be rotatable relative to the ring stop 356. For example, as the indexing pin 322 engages the wall 324 and one or both of the indexing sleeve 316 and the indexing ring 320 rotate, the indexing pin 322 may slide along the wall 324. A rotating indexing pin 322 may roll along the wall 324 rather than slide along the wall. This may reduce wear on the wall 324 and/or the indexing pin 322 during repeated cycling of the indexing mechanism 312.

In some embodiments, the indexing ring 320 may include a plurality of indexing pins 322 connected to a plurality of ring stops 356. For example, the indexing ring 320 may include two, three, four, or more indexing pins 322 and ring stops 356.

The indexing pin may extend into a track 350 of an indexing track 318 of the indexing sleeve 316. The indexing ring 320 may be secured to the housing 328 with a ring support 358. The ring support 358 may be longitudinally and rotationally fixed to the housing 328 with any type of connection, such as a threaded connection, a bolted connection, a weld, braze, or any other type of connection. The indexing ring 320 may rotate relative to the ring support 358. In at least one embodiment, the indexing ring 320 may rotate directly against the ring support 358, or without any bearings. In other embodiments, the indexing ring 320 may rotate against the ring support 358 against a bearing, such as an axial or a radial bearing. In some embodiments, the indexing ring 320 may be directly secured to the housing 328. For example, the indexing ring 320 may be inserted into a annular channel machined or cast into the inner wall of the housing 328.

As the piston 314 and the indexing sleeve 316 move longitudinally downhole, a wall 324 of the indexing track 318 may engage the indexing pin 322. Thus, the indexing pin 322 may be inserted far enough into the indexing track 318 and the track 350 to contact the wall 324. In at least one embodiment, the indexing pin 322 may contact a bottom surface 360 of the track 350. When the indexing pin 322 contacts the wall 324, the indexing sleeve 316 may be pushed toward the upper sleeve block 352-1. Uphole movement of the indexing sleeve 316 may be stopped by the upper sleeve block 352-1, and a torque may be applied to the indexing sleeve 316 and the indexing ring 320.

The torque may be greater than a sleeve breakout torque of the indexing sleeve 316, and the indexing sleeve 316 may rotate relative to the piston 314. In at least one embodiment, the upper sleeve block 352-1 may be rotationally fixed to the piston 314, and the indexing sleeve 316 may rotate directly against the upper sleeve block 352-1, without any bearings. In other embodiments, the upper sleeve block 352-1 may be a bearing, such as a thrust bearing or a ball bearing.

As the piston 314 and the indexing sleeve 316 move further downhole, a sleeve stop 362 on the indexing sleeve 316 may contact or engage the ring stop 356. This may cause the piston 314 and the indexing sleeve 316 to stop moving downhole. In some embodiments, the sleeve stop 362 may directly engage the ring stop 356. The ring stop 356 may be sized to stop the motion of the piston 314 and the indexing sleeve 316 without damage. In other embodiments, the sleeve stop 362 may engage the indexing pin 322, and the indexing pin 322 may be sized to stop the motion of the piston 314 and the indexing sleeve 316 without damage. Thus, in some embodiments, the sleeve stop 362 may be located uphole of the ring stop 356. Locating the sleeve stop 362 uphole of the ring stop 356 may reduce the number of parts of the system, which may reduce the manufacturing cost. Furthermore, locating the indexing pin 322 in the indexing ring 320 may shorten the length of the indexing sleeve 316, which may reduce manufacturing costs and reduce the length the indexing sleeve 316 has to move to cycle the indexing mechanism 312.

Figures 1, 4:
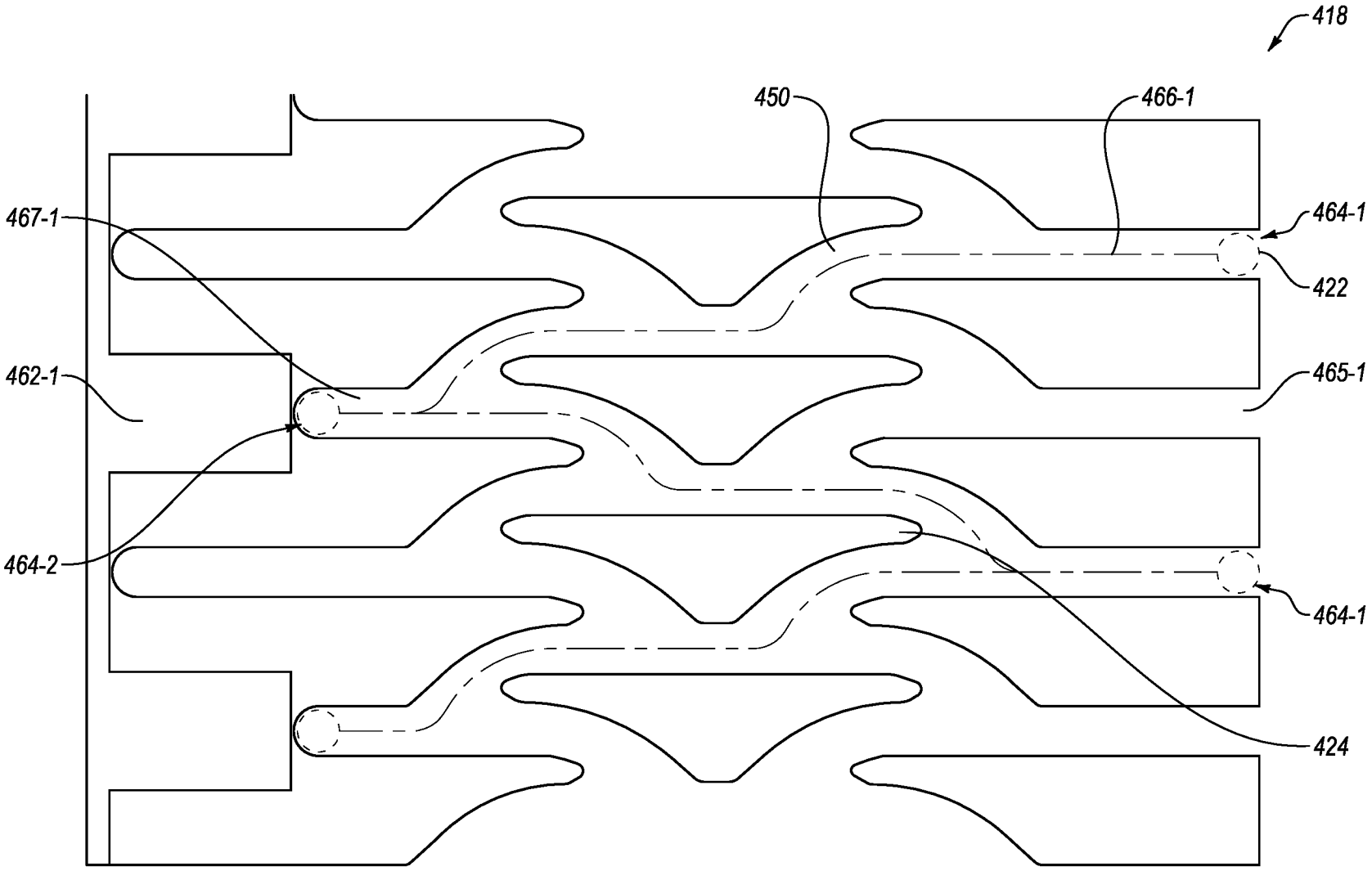
Figures 2, 4:
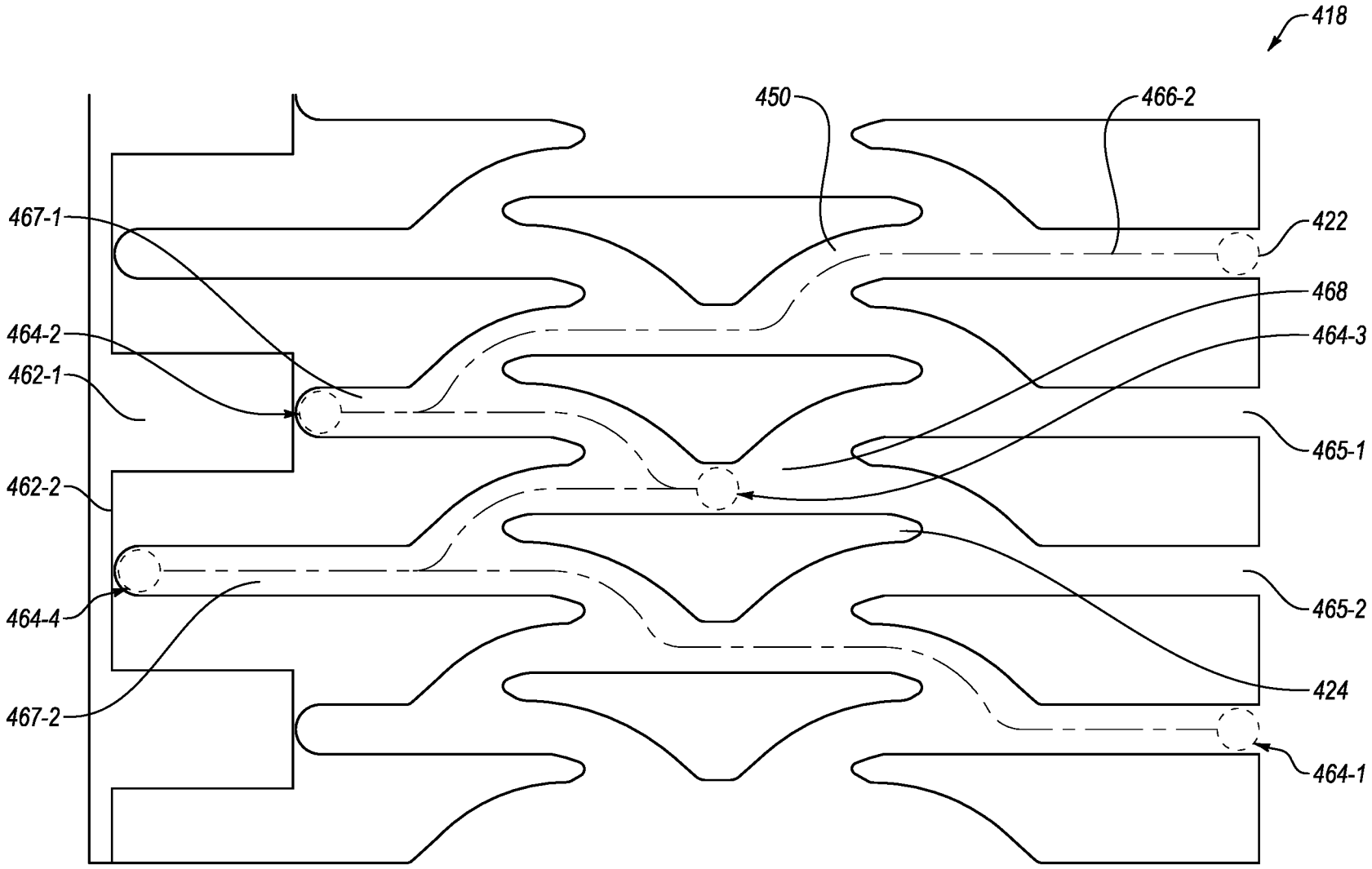

FIG. 4-1 is a representation of an indexing track 418, according to at least one embodiment of the present disclosure. The indexing track 418 may include a track 450 located between walls 424 in the indexing track 418. An indexing pin 422 may be installed in a ring stop (e.g., the ring stop 356 of FIG. 3) of an indexing ring (e.g., indexing ring 220 of FIG. 2-1). The indexing pin may extend into the track 450 at a first longitudinal piston position 464-1 (e.g., the position shown in FIG. 2-1 and FIG. 2-2). As an indexing sleeve (e.g., the indexing sleeve 216 of FIG. 2-1), in which the indexing track 418 is located, is moved downhole, the indexing pin 422 may follow a first indexing pin path 466-1. The walls 424 may direct the indexing pin 422 until the piston (e.g., piston 214 of FIG. 2-2) and the indexing sleeve are stopped a second longitudinal piston position 464-2. This may occur, for instance, when the fluid flow (e.g., the fluid flow 244 of FIG. 2-2) is increased to a high flow state. A first sleeve stop 462-1 may engage a ring stop and stop downhole movement of the piston and the indexing sleeve at the second longitudinal piston position 464-2.

In the second longitudinal piston position 464-2, fluid flow to a fluid path (e.g., fluid path 240 of FIG. 2-2) may be blocked by the piston. When the fluid flow is decreased to a low flow state, then the piston and the indexing sleeve may move uphole, and the walls 424 may direct the indexing pin 422 until the piston and the indexing sleeve are back to the first longitudinal piston position. In this manner, the cycling of the indexing mechanism may be repeated indefinitely without allowing fluid flow into the fluid path. In other words, the cycling of the indexing mechanism may be repeated indefinitely without actuating a downhole tool.

In the second longitudinal piston position 464-2, the indexing ring and the indexing sleeve may be in a first indexing alignment. In the first indexing alignment, the indexing ring may be in one of a first lower straight section 465-1 of the indexing track 418 and a first upper straight section 467-1 of the indexing track 218, the first lower straight section 465-1 and the first upper straight section 467-1 being in line in the indexing track 418. For instance, the first lower straight section 465-1 and the first upper straight section 467-1 may be in the same circumferential position on the indexing sleeve. Furthermore, in the first indexing alignment, the ring stop may be aligned to contact a first sleeve stop 462-1 on the indexing sleeve such that the first sleeve stop 462-1 contacts the ring stop in the second longitudinal piston position 464-2.

FIG. 4-2 is a representation of the indexing track 418 of FIG. 4-1, according to at least one embodiment of the present disclosure. The indexing track 418 may include a track 450 located between walls 424 in the indexing track 418. An indexing pin 422 may extend into the track 450 at a first longitudinal piston position 464-1. As the flow is increased from the low flow state to the high flow state, the piston and the indexing sleeve are moved downhole, the indexing pin 422 may follow a second indexing pin path 466-2. The second indexing pin path 466-2 may follow the same initial path as the first indexing pin path 466-1 shown in FIG. 4-1 until the piston and the indexing sleeve are in the second longitudinal piston position 464-2.

To actuate a downhole tool, fluid flow may be reduced to an indexing flow between the high flow state and the low flow state. At the indexing flow, the piston and indexing sleeve may be moved to a third longitudinal piston position 464-3. The third longitudinal piston position 464-3 may be between the first longitudinal piston position 464-1 and the second longitudinal piston position 464-2. In the third longitudinal piston position 464-3, the indexing ring and the indexing sleeve may be in a second indexing alignment. In the second indexing alignment, the indexing pin 422 may be in middle section 468 of the indexing track, and not aligned with the first lower straight section 465-1, a second lower straight section 465-2, a first upper straight section 467-1, or a second upper straight section 475-2. Thus, the ring stop may not be aligned with either the first sleeve stop 462-1 or the second sleeve stop 462-2.

The fluid flow may then be increased from the indexing flow to the high flow. This may cause the indexing pin 422 to direct the piston and the indexing sleeve to a fourth longitudinal piston position 464-4. In at least one embodiment, the first sleeve stop 462-1 may engage a ring support in the fourth longitudinal piston position and halt downhole movement of the piston and the indexing sleeve. The ring support may include a surface downhole of the indexing ring against which the first sleeve stop 462-1 may contact, thereby preventing further longitudinal movement of the piston and the indexing sleeve.

In the same or other embodiments, a second sleeve stop 462-2 may engage the ring stop and halt downhole movement of the piston and the indexing sleeve. In some embodiments, the indexing sleeve may both contact the ring stop and the second sleeve stop 462-2 may engage the ring stop in the fourth longitudinal piston position. In the fourth longitudinal piston position 464-4, the indexing ring and the indexing sleeve may be in a third indexing alignment. In the third indexing alignment, the indexing ring may be in one of the second lower straight section 465-2 and the second upper straight section 467-2, the second lower straight section 465-2 and the second upper straight section 467-2 being in line in the indexing track 418. For instance, the second lower straight section 465-2 and the second upper straight section 467-2 may be in the same circumferential position on the indexing sleeve. Furthermore, in the third indexing alignment, the first sleeve stop 462-1 may be aligned to contact the ring support between two ring stops, and/or the ring stop may be aligned to contact the second sleeve stop 462-2 on the indexing sleeve such that the first sleeve stop 462-1 contacts the ring support and/or the second sleeve stop 462-2 contacts the ring stop in the fourth longitudinal piston position 464-4. In other words, in the third indexing alignment, the ring stop may be longitudinally offset from the first sleeve stop 462-1 in the fourth longitudinal piston position and the third indexing alignment.

In the fourth longitudinal piston position 464-4, the fluid path may be open to the fluid flow. In this manner, the fluid flow may actuate a downhole tool. When the fluid flow is reduced to the low flow state, then the indexing pin 422 may direct the piston and the indexing sleeve back to the first longitudinal piston position 464-1. When the fluid flow is increased back to the high flow state, then the indexing pin 422 may direct the piston and the indexing sleeve back to the fourth longitudinal piston position 464-4. In this manner, the downhole tool may be indefinitely cycled between actuating a downhole tool and deactivating a downhole tool by changing the fluid flow from the low flow state to the high flow state and back again.

Figures 1, 5:
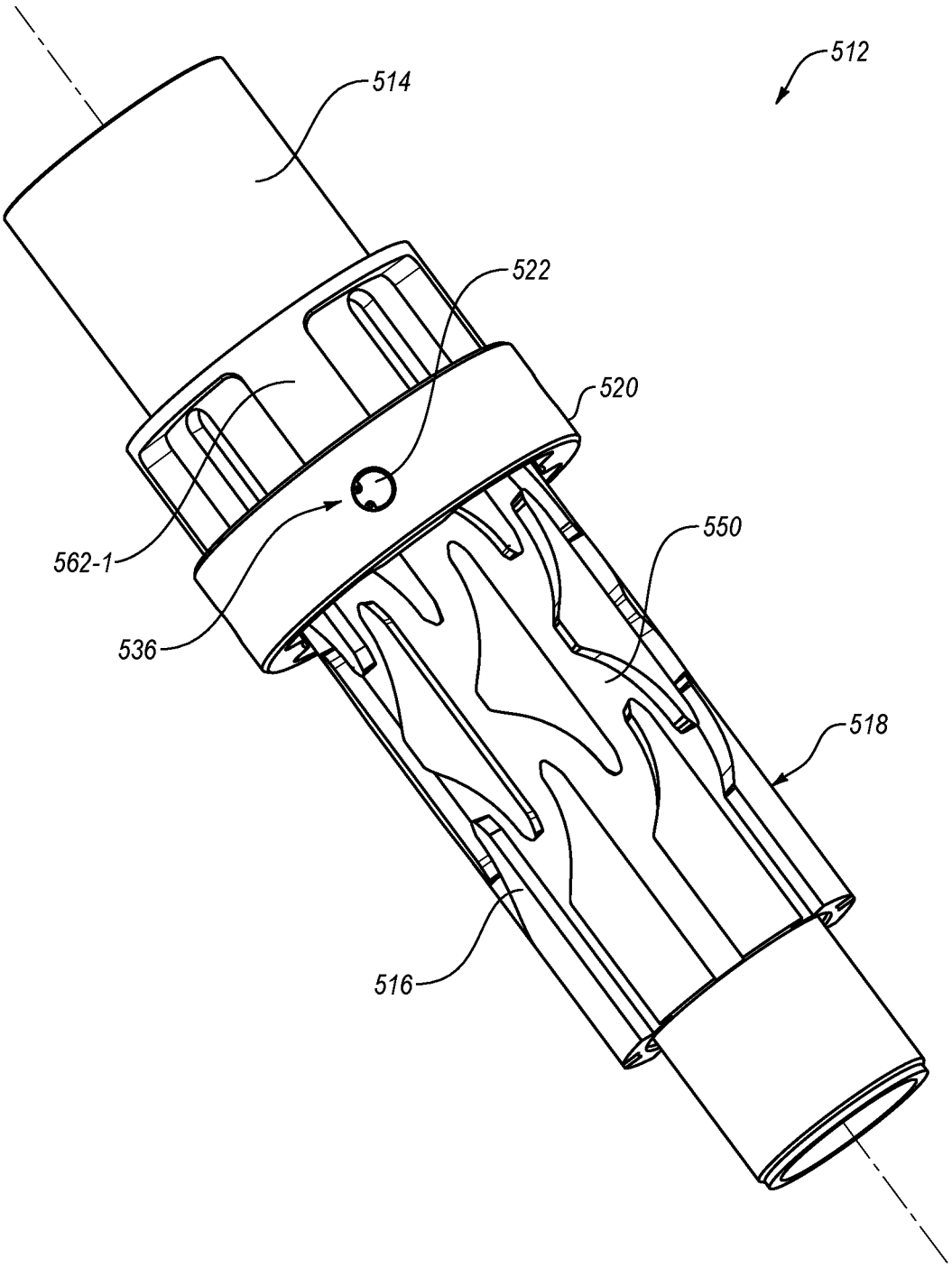
Figures 2, 5:
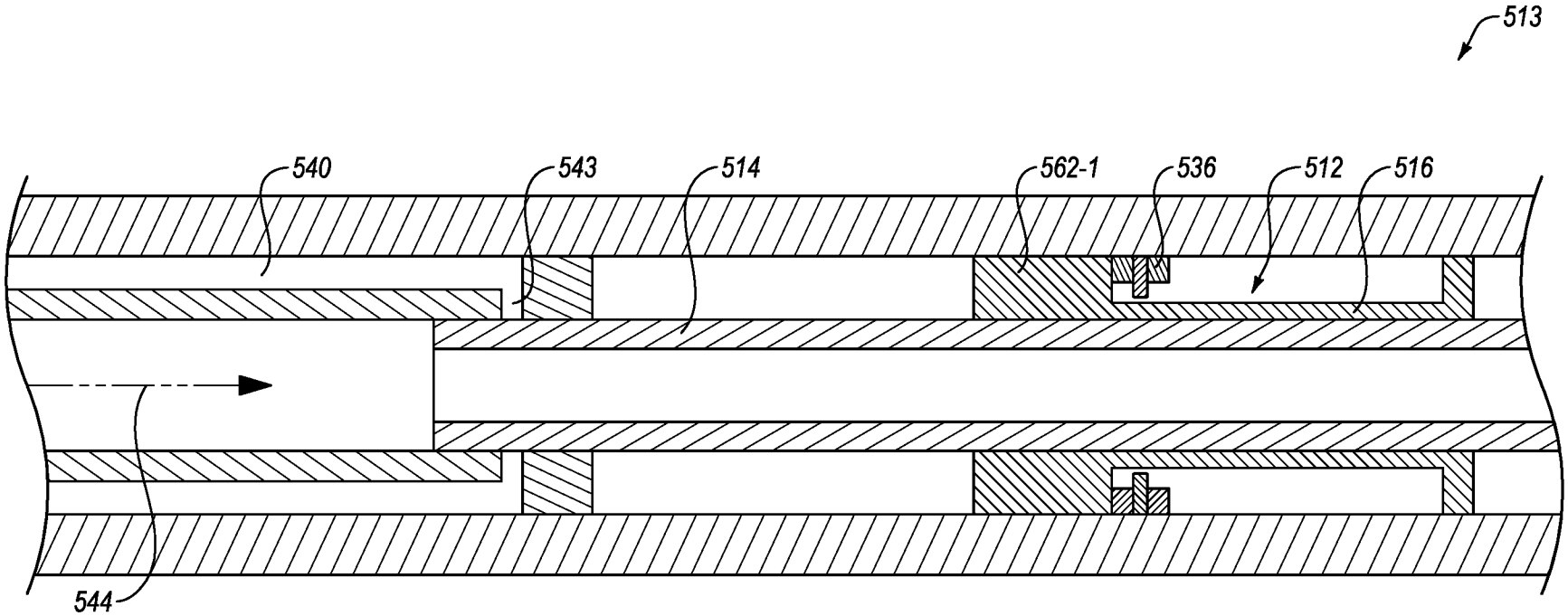

FIG. 5-1 is a representation of an indexing mechanism 512, according to at least one embodiment of the present disclosure. The indexing mechanism 512 may be in the second longitudinal piston position (e.g., second longitudinal piston position 464-2 of FIG. 4-1). As a piston 514 and an indexing sleeve 516 are moved into the second longitudinal position, one or both of the indexing sleeve 516 and an indexing ring 520 may be rotated to place the indexing sleeve 516 and the indexing ring 520 in a first indexing alignment. In the first indexing alignment (and the second longitudinal piston position) a first sleeve stop 562-1 may be aligned to contact a ring stop 536 on the indexing ring 520. An indexing pin inserted into a track 550 of an indexing track 518. Thus, the first sleeve stop 562-1 may be located uphole of the ring stop 536.

In some embodiments, the first sleeve stop 562-1 may be fixed to the indexing sleeve 516. For example, the first sleeve stop 562-1 may be rotationally and longitudinally fixed to the indexing sleeve 516. The first sleeve stop 562-1 may be integrally formed with the indexing sleeve 516. For example, the first sleeve stop 562-1 may be machined, cast, chemically etched, or otherwise formed from a single unitary piece of the indexing sleeve 516. In other embodiments, the first sleeve stop 562-1 may be attached to the indexing sleeve 516. For example, the first sleeve stop 562-1 may be welded, brazed, attached with a mechanical fastener, press-fit, interference fit, or otherwise attached to the indexing sleeve 516. In still other embodiments, the first sleeve stop 562-1 may be attached to the piston 514 and overlap the indexing sleeve 516.

FIG. 5-2 is a cross-sectional view of a downhole tool 513, including a cross-sectional view of the indexing mechanism 512 of FIG. 5-1. In the embodiment shown, the indexing mechanism 512 is in the second longitudinal piston position and the first indexing alignment. Thus, the ring stop 536 may be contacting the first sleeve stop 562-1, thereby blocking downhole movement of the piston 514 and the indexing sleeve 516. While the fluid flow 544 is in a high flow state, the piston 514 may be blocking a channel opening 543 to a fluid path 540. This may prevent the downhole tool 513 from actuating (i.e., prevent an expandable member from expanding.)

Figure 6:
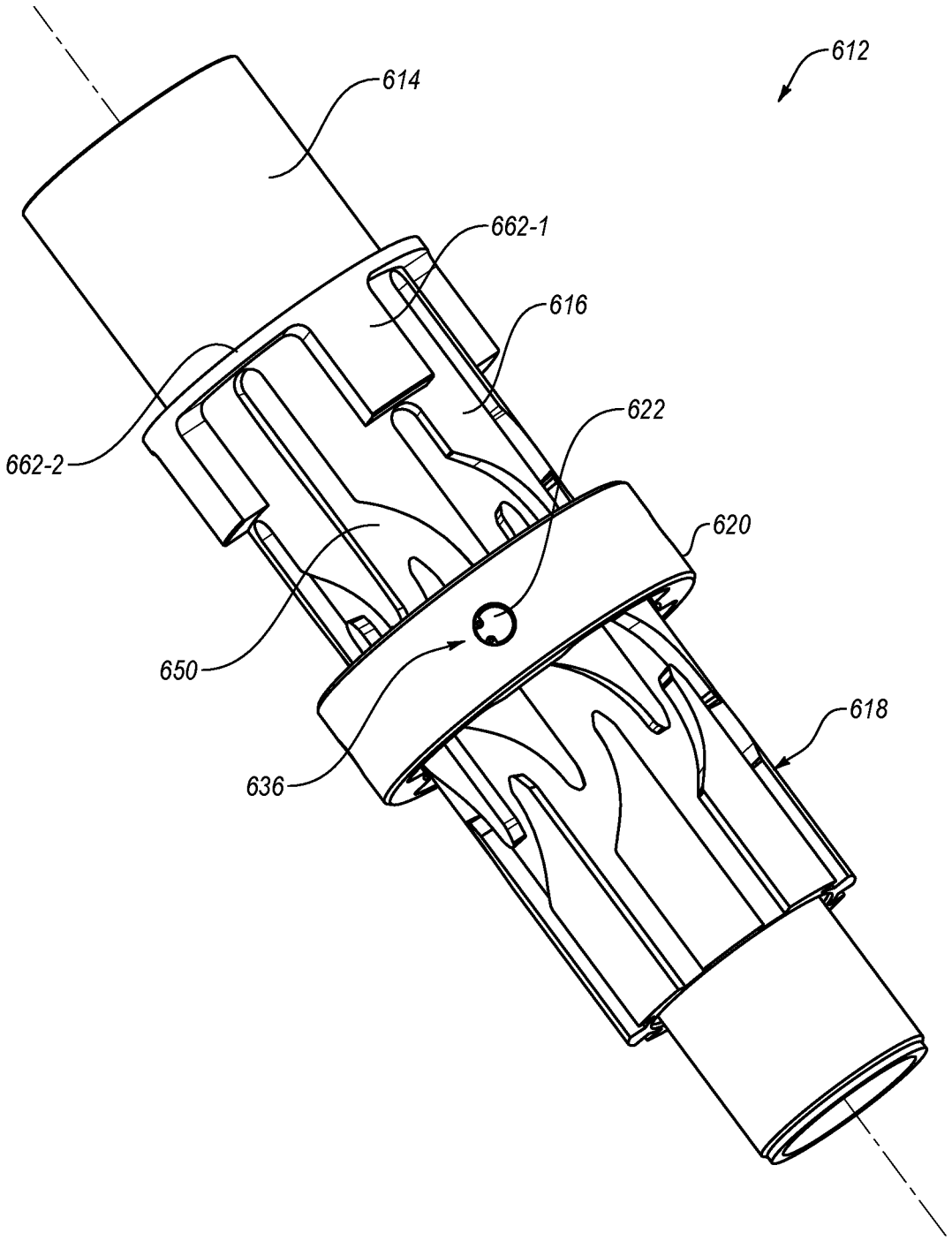
FIG. 6 is a perspective view of an indexing mechanism, according to at least one embodiment of the present disclosure.

FIG. 6 is a perspective view of an indexing mechanism 612 in a third longitudinal piston position, according to at least one embodiment of the present disclosure. As a piston 614 and an indexing sleeve 616 are moved into the third longitudinal piston position, the indexing ring 620 and the indexing sleeve 616 are rotated into a second indexing alignment. An indexing pin 622 connected to a ring stop 636 on the indexing ring 620 may be inserted into a track 650 of an indexing track 618. In the second indexing alignment, the ring stop 650 may be misaligned with either a first sleeve stop 662-1 or a second sleeve stop 662-2.

In some embodiments, the second sleeve stop 662-2 may be fixed to the indexing sleeve 616. For example, the second sleeve stop 662-2 may be rotationally and longitudinally fixed to the indexing sleeve 616. The second sleeve stop 662-2 may be integrally formed with the indexing sleeve 616. For example, the second sleeve stop 662-2 may be machined, cast, chemically etched, or otherwise formed from a single unitary piece of the indexing sleeve 616. In other embodiments, the second sleeve stop 662-2 may be attached to the indexing sleeve 616. For example, the second sleeve stop 662-2 may be welded, brazed, attached with a mechanical fastener, press-fit, interference fit, or otherwise attached to the indexing sleeve 616. In still other embodiments, the second sleeve stop 662-2 may be attached to the piston 614 and overlap the indexing sleeve 16.

In some embodiments, the first sleeve stop 662-1 and the second sleeve stop 662-2 may be integrally formed. In other embodiments, the first sleeve stop 662-1 and the second sleeve stop 662-2 may be separate pieces, and individually attached to or formed with the indexing sleeve 616.

Figures 1, 7:
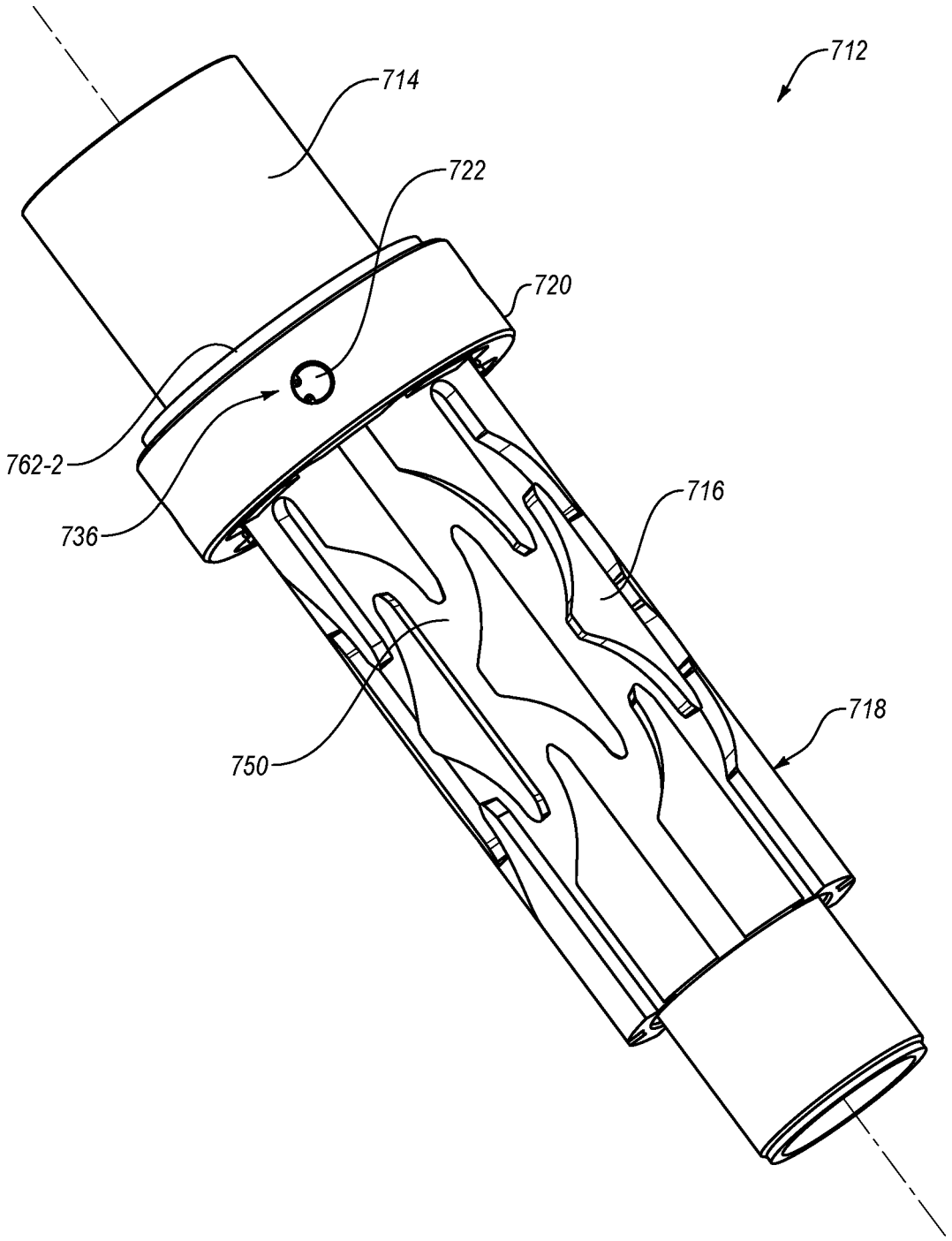
Figures 2, 7:
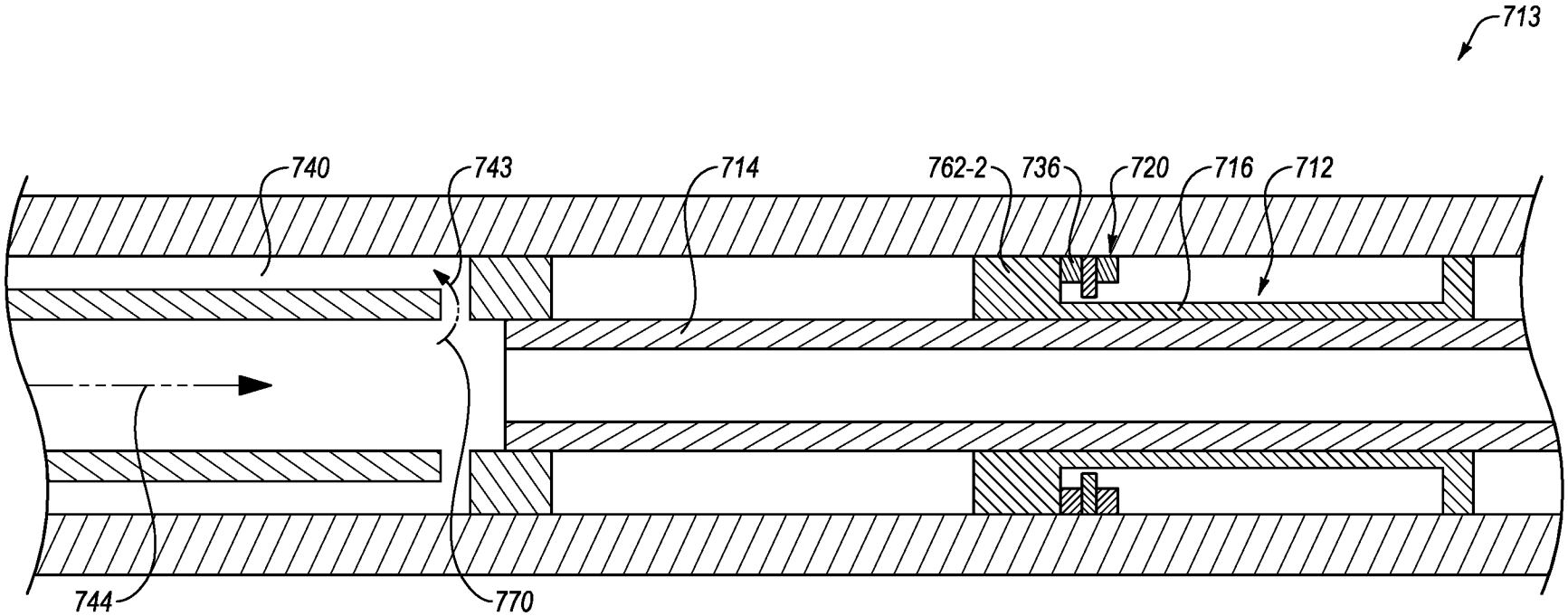

FIG. 7-1 is a perspective view of an indexing mechanism 712 in a fourth longitudinal piston position, according to at least one embodiment of the present disclosure. As a piston 714 and an indexing sleeve 716 are moved into the fourth longitudinal piston position, at least one of an indexing ring 720 and/or the indexing sleeve are rotated into a third indexing alignment. An indexing pin 722 connected to a ring stop 736 on the indexing ring 720 may be inserted into a track 750 of an indexing track 718. In the fourth longitudinal piston position and the third indexing alignment, the first ring stop (e.g., first ring stop 562-1 of FIG. 5-2) may engage a ring support between two ring stops 736 on the indexing ring. In the same or other embodiments, a second sleeve stop 762-2 may engage the ring stop 736. The ring stop 736 may prevent further downhole movement of the piston 714 and the indexing sleeve 716.

FIG. 7-2 is a cross-sectional view of a downhole tool 713, including a cross-sectional view of the indexing mechanism 712 of FIG. 7-1, according to at least one embodiment of the present disclosure. In the embodiment shown, the piston 714 and the indexing sleeve 716 are in the fourth longitudinal piston position. As may be seen, the piston 714 has uncovered the channel opening 743, thereby allowing a portion 770 of fluid from the fluid flow 744 to enter the fluid path 740. The portion 770 of fluid may be directed to actuate a downhole tool, such as an expandable tool. In the fourth longitudinal piston position, the first ring stop may engage a ring support between two ring stops 736 on the indexing ring. In the same or other embodiments, a ring stop 736 on the indexing ring 720 may engage the second sleeve stop 762-2 on the indexing sleeve 716, thereby preventing further downhole movement of the piston 714 and the indexing sleeve 716.

Figure 8:
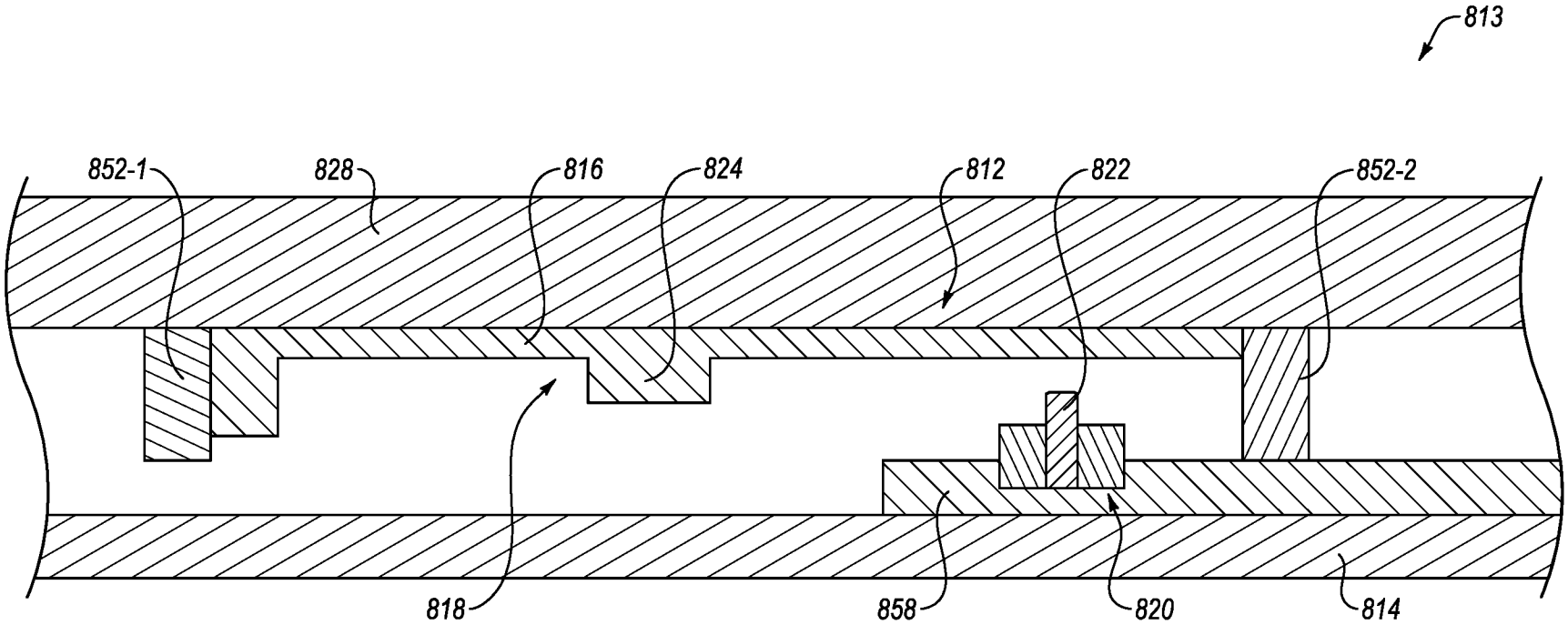
FIG. 8 is a cross-sectional view of another indexing mechanism, according to at least one embodiment of the present disclosure.

FIG. 8 is a cross-sectional view of a downhole tool 813, according to at least one embodiment of the present disclosure. The downhole tool 813 may include an indexing mechanism 812. The indexing mechanism 812 may include a piston 814. An indexing ring 820 may surround at least a portion of the piston 814 and be rotatable relative to the piston 814. The indexing ring 820 may be secured to a ring support 858 secured to the piston 814. The ring support 858 may be longitudinally secured to the piston 814 such that as the piston 814 moves longitudinally, the indexing ring 820 may move longitudinally. Thus, the indexing ring 820 may be longitudinally fixed to the piston 814.

An indexing sleeve 816 may be located radially outward from the indexing ring 820 and the piston 814. The indexing sleeve 816 may abut a housing 828 of the downhole tool 813. The indexing sleeve 816 may be rotatable relative to the housing 828. The indexing sleeve may be longitudinally fixed to the housing 828 with an upper sleeve block 852-1 and a lower sleeve block 852-2. As the piston 814 moves longitudinally relative to the indexing sleeve 816, the indexing ring 820 may move longitudinally along the indexing sleeve 816.

The indexing pin 822 may engage a wall 824 of an indexing track 818 of the indexing sleeve 816. This may cause one or both of the indexing sleeve 816 and the indexing ring 820 to rotate relative to each other and the piston 814. In this manner, the indexing track 818 may be located in an inner surface of the indexing sleeve.

Figure 9:
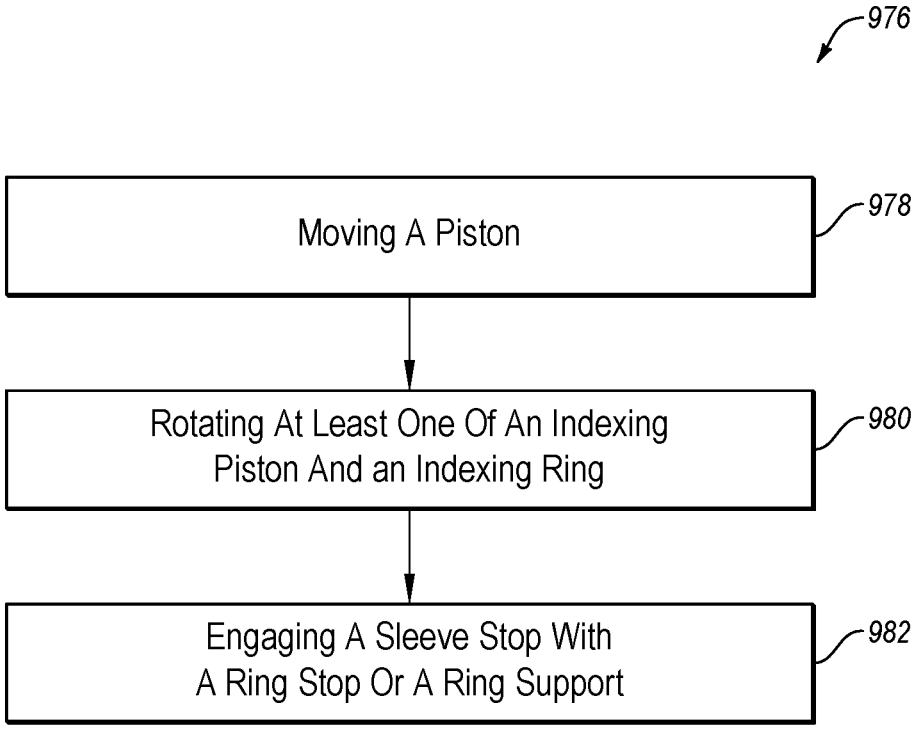
FIG. 9 is a method chart of a method for operating an indexing mechanism, according to at least one embodiment of the present disclosure.

FIG. 9 is a method chart of a method 976 for operating an indexing mechanism. The method 976 may include moving a piston from a first longitudinal piston position to a second longitudinal piston position at 978. Moving the piston may include moving an indexing sleeve from the first longitudinal piston position to the second longitudinal piston position, the indexing sleeve encasing at least a portion of the piston. Moving the piston may include increasing a fluid flow from a first flow rate to a second flow rate, the second flow rate being higher than the first flow rate.

The method 976 may include rotating at least one of an indexing sleeve and/or an indexing ring relative to the piston at 980 to an alignment. Rotating the indexing sleeve and/or the indexing ring may be in response to the longitudinal movement of the piston and/or the indexing sleeve. For example, moving the piston and the indexing sleeve longitudinally may cause an indexing pin located in a ring stop of the indexing ring to engage an indexing track of the indexing piston. This may apply a torque to the indexing ring and the indexing sleeve, thereby causing one or both of the indexing ring and the indexing sleeve to rotate. The indexing track of the indexing piston may be shaped such that at least one of the indexing sleeve and/or the indexing track may rotate to self-align or automatically align stopping or positioning features on the indexing mechanism. For example, the indexing sleeve may include a sleeve stop and the indexing ring may include a ring stop, and the indexing track may be shaped to align the sleeve stop with the ring stop such that the sleeve stop may contact the ring stop. In other examples, the indexing sleeve may include the sleeve stop and the indexing ring may include a gap between two ring stops, and the sleeve stop may be aligned to pass through the gap between the ring stops and contact a ring support, the ring support holding the indexing ring in place.

In at least one embodiment, rotating at least one of the indexing sleeve and/or the indexing ring may include rotating the indexing sleeve and the indexing ring relative to each other. In the same or other embodiments, rotating at least one of the indexing sleeve and/or the indexing ring may include rotating the indexing sleeve in a first direction and the indexing ring in a second direction, the first direction being different from the second direction. Rotating at least one of the indexing sleeve and/or the indexing ring may include aligning the indexing sleeve and the indexing piston into a first indexing alignment, the first indexing alignment aligning a ring stop on the indexing ring with a first sleeve stop on the indexing sleeve such that a first sleeve stop on the indexing sleeve contacts a ring stop on the indexing ring in the second longitudinal piston position.

The method 976 may include engaging the aligned stopping or positioning features at 982, which may result in the indexing sleeve being stopped in a terminal longitudinal piston position. In other words, the method 976 may include engaging the sleeve stop with the ring stop or the ring support. For example, the sleeve stop of the indexing sleeve may be aligned to engage or contact the ring stop of the indexing ring, thereby stopping the indexing sleeve in a terminal longitudinal piston position, or the second longitudinal piston position. In another example, the sleeve stop of the indexing sleeve may be aligned to engage or contact the ring support that supports the indexing ring, thereby stopping the indexing sleeve in a terminal longitudinal position, or the fourth longitudinal piston position.

The method 976 may further include moving the piston from the second longitudinal piston position to a third longitudinal piston position, the third longitudinal piston position being between the first longitudinal piston position and the second longitudinal position. Moving the piston may include changing the fluid flow from the second flow rate to a third flow rate, the third flow rate being between the first flow rate and the second flow rate. Moving the piston to the third longitudinal position may include rotating at least one of the indexing sleeve and/or the indexing ring relative to the piston to a second indexing alignment.

The method 976 may further include moving the piston from the third longitudinal piston position to a fourth longitudinal piston position, the fourth longitudinal piston position being further from the first longitudinal piston position than the second longitudinal piston position. Moving the piston may include rotating at least one of the indexing sleeve and/or the indexing ring relative to the piston to a third indexing alignment. The third indexing alignment may align the ring stop with a second sleeve stop such that the second sleeve stop contacts the ring stop in the fourth longitudinal piston position.

In some embodiments, a downhole tool includes a piston, an indexing sleeve encasing a portion of the piston, and an indexing ring surrounding less than an entirety of the indexing sleeve. The indexing sleeve is rotatable relative to the piston. The indexing ring includes an indexing pin extending into the indexing track. The indexing ring may be rotatable relative to the indexing sleeve. The indexing sleeve may be longitudinally fixed to the piston. The indexing sleeve and the indexing ring may rotate relative to the piston in response to a longitudinal motion of the piston. The indexing sleeve and the indexing ring may rotate relative to the piston in response to the indexing pin engaging the indexing track. The indexing ring may have a mass of 2 kg or less, and the indexing sleeve may have a mass of 8 kg or less. The indexing ring and the indexing sleeve may have a mass ratio of less than 1:4. The indexing track may include a first sleeve stop and a second sleeve stop. The first sleeve stop may engage a ring stop in a first longitudinal piston position, and may engage a ring support in a second longitudinal piston position. The second longitudinal piston position may be further uphole than the first longitudinal piston position.

In some embodiments, a downhole tool includes a piston, an indexing sleeve with an indexing track, and an indexing ring surrounding a portion of the indexing sleeve. The indexing sleeve encases a portion of the piston. The indexing ring includes a ring stop and an indexing pin extending into the indexing track. The indexing ring is rotatable relative to the piston. The indexing pin may be located in the ring stop. The indexing sleeve may include a sleeve stop located uphole of the ring stop. The sleeve stop may engage the ring stop in a high flow state. The indexing ring may extend less than 10% of length of the piston.

In some embodiments, a method for operating an indexing mechanism includes moving a piston from a first longitudinal piston position to a second longitudinal piston position, and rotating at least one of an indexing sleeve or an indexing ring relative to the piston to a first indexing alignment. The indexing sleeve encases less than an entirety of the piston and the indexing ring surrounds a portion of the indexing sleeve. The first indexing alignment aligns a ring stop on the indexing ring with a first sleeve stop on the indexing sleeve such that the first sleeve stop engages the ring stop in the second longitudinal piston position. The method may include moving the piston from the second longitudinal piston position to a third longitudinal piston position that is between the first longitudinal piston position and the second longitudinal piston position. The method may include rotating at least one of the indexing sleeve or the indexing ring relative to the piston to a second indexing alignment. The method may also include moving the piston from the third longitudinal piston position to a fourth longitudinal piston position that is further from the first longitudinal piston position than the second longitudinal piston position. The method may include rotating at least one of the indexing sleeve or the indexing ring relative to the piston to a third indexing alignment, the third indexing alignment aligns the ring stop with a second sleeve stop such that the second sleeve stop contacts the ring stop in the fourth longitudinal piston position. The method may include rotating at least one of the indexing sleeve or the indexing ring by rotating the indexing ring relative to the indexing sleeve. The method may include rotating at least one of the indexing sleeve or the indexing ring by rotating the indexing sleeve in a first direction and rotating the indexing ring in a second direction that is different than the first direction.

The embodiments of the indexing mechanism have been primarily described with reference to wellbore drilling operations; the indexing mechanisms described herein may be used in applications other than the drilling of a wellbore. In other embodiments, indexing mechanisms according to the present disclosure may be used outside a wellbore or other downhole environment used for the exploration or production of natural resources. For instance, indexing mechanisms of the present disclosure may be used in a borehole used for placement of utility lines. Accordingly, the terms "wellbore," "borehole" and the like should not be interpreted to limit tools, systems, assemblies, or methods of the present disclosure to any particular industry, field, or environment.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

The articles "a," "an," and "the" are intended to mean that there are one or more of the elements in the preceding descriptions. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A downhole tool, comprising:

a piston;

an indexing sleeve encasing a portion of the piston, the indexing sleeve being rotatable relative to the piston, the indexing sleeve including an indexing track; and an indexing ring surrounding less than an entirety of the indexing sleeve, the indexing ring being rotatable relative to the piston in operation of the downhole tool, the indexing ring including an indexing pin, the indexing pin extending into the indexing track.

2. The downhole tool of claim 1, the indexing ring being rotatable relative to the indexing sleeve.

3. The downhole tool of claim 1, the indexing sleeve being longitudinally movable relative to the indexing ring.

4. The downhole tool of claim 1, the indexing sleeve being longitudinally fixed to the piston.

5. The downhole tool of claim 1, the indexing sleeve and the indexing ring rotating relative to the piston in response to a longitudinal motion of the piston.

6. The downhole tool of claim 1, the indexing sleeve and the indexing ring rotating relative to the piston in response to the indexing pin engaging the indexing track.

7. The downhole tool of claim 1, the indexing ring having a mass of 2 kg or less and the indexing sleeve having a mass of 8 kg or less.

8. The downhole tool of claim 1, the indexing ring and the indexing sleeve having a mass ratio of less than 1:4.

9. The downhole tool of claim 1, the indexing track including a first sleeve stop and a second sleeve stop.

10. The downhole tool of claim 9, the first sleeve stop engaging a ring stop in first longitudinal piston position and the first sleeve stop engaging a ring support in a second longitudinal piston position, the second longitudinal piston position being further uphole than the first longitudinal piston position.

11. A method for operating an indexing mechanism, comprising:

moving a piston from a first longitudinal piston position to a second longitudinal piston position; and rotating at least one of an indexing sleeve or an indexing ring relative to the piston to a first indexing alignment, the indexing sleeve encasing less than an entirety of the piston and the indexing ring surrounding a portion of the indexing sleeve, the first indexing alignment aligning a ring stop on the indexing ring with a first sleeve stop on the indexing sleeve such that the first sleeve stop engages the ring stop in the second longitudinal piston position.

12. The method of claim 11, further comprising:

moving the piston from the second longitudinal piston position to a third longitudinal piston position, the third longitudinal piston position being between the first longitudinal piston position and the second longitudinal piston position; and rotating at least one of the indexing sleeve or the indexing ring relative to the piston to a second indexing alignment.

13. The method of claim 12, further comprising:

moving the piston from the third longitudinal piston position to a fourth longitudinal piston position, the fourth longitudinal piston position being further from the first longitudinal piston position than the second longitudinal piston position; and rotating at least one of the indexing sleeve or the indexing ring relative to the piston to a third indexing alignment, the third indexing alignment aligning the ring stop with a second sleeve stop such that the second sleeve stop contacts the ring stop in the fourth longitudinal piston position.

14. The method of claim 11, wherein rotating at least one of the indexing sleeve or the indexing ring includes rotating the indexing ring relative to the indexing sleeve.

15. The method of claim 11, wherein rotating at least one of the indexing sleeve or the indexing ring includes rotating the indexing sleeve in a first direction and rotating the indexing ring in a second direction, the first direction being different than the second direction.

16. A downhole tool, comprising:

a piston;

an indexing sleeve encasing a portion of the piston, the indexing sleeve being rotatable relative to the piston, the indexing sleeve including an indexing track; and an indexing ring surrounding less than an entirety of the indexing sleeve, the indexing ring being rotatable relative to the piston, the indexing ring including an indexing pin, the indexing pin extending into the indexing track;

wherein the indexing sleeve and the indexing ring rotating relative to the piston in response to a longitudinal motion of the piston.

17. The downhole tool of claim 16, the indexing ring being rotatable relative to the indexing sleeve.

18. The downhole tool of claim 16, the indexing sleeve being longitudinally movable relative to the indexing ring.

19. The downhole tool of claim 15, the indexing sleeve being longitudinally fixed to the piston.

20. The downhole tool of claim 16, the indexing ring and the indexing sleeve having a mass ratio of less than 1:4.

* * * * *